US010267104B2

(12) United States Patent
Craig Wall

(10) Patent No.: US 10,267,104 B2
(45) Date of Patent: Apr. 23, 2019

(54) SEMIAUTOMATED DRILL ROD HANDLING APPARATUS AND METHOD, HAND-HELD HAUL PLUG SPINNER AND HAUL PLUG COMBINATION AND DRILL ROD HANDLING SYSTEM WITH BOTH

(71) Applicant: EXPLORATION DRILL MASTERS CHILE S.A., Santiago de Chile (CL)

(72) Inventor: Ryan Craig Wall, Santiago de Chile (CL)

(73) Assignee: EXPLORATION DRILL MASTERS CHILE S.A., Santiago de Chile (CL)

( * ) Notice: Subject to any disclaimer, the term of this patent is extended or adjusted under 35 U.S.C. 154(b) by 171 days.

(21) Appl. No.: 15/327,363

(22) PCT Filed: Jun. 15, 2015

(86) PCT No.: PCT/CL2015/050018
§ 371 (c)(1),
(2) Date: Jan. 18, 2017

(87) PCT Pub. No.: WO2016/008060
PCT Pub. Date: Jan. 21, 2016

(65) Prior Publication Data

US 2017/0167208 A1 Jun. 15, 2017

(30) Foreign Application Priority Data

Jul. 18, 2014 (AU) ..... 2014204515

(51) Int. Cl.
*E21B 19/15* (2006.01)
*E21B 19/14* (2006.01)
(Continued)

(52) U.S. Cl.
CPC ..... *E21B 19/155* (2013.01); *E21B 15/00* (2013.01); *E21B 19/008* (2013.01); *E21B 19/06* (2013.01);
(Continued)

(58) Field of Classification Search
CPC ..... E21B 19/15; E21B 19/155
See application file for complete search history.

(56) References Cited

U.S. PATENT DOCUMENTS 3,177,944 A * 4/1965 Knights ..... E21B 19/15 166/77.53
3,991,887 A 11/1976 Trout
(Continued)

FOREIGN PATENT DOCUMENTS

WO 2006038790 A1 4/2006

OTHER PUBLICATIONS

International Search Report and Written Opinon for PCT App No. PCT/CL2015/050018 dated Mar. 3, 2016, 11 pgs.

*Primary Examiner* — Shane Bomar
(74) *Attorney, Agent, or Firm* — Procopio, Cory, Hargreaves & Savitch LLP

(57) ABSTRACT

A semi-automated drill rod handling apparatus and method is provided for a drilling rig of the type having a main winch and haul plug with adapter for assembling and disassembling the drill string and carrying drill rods between a drill rod stowage platform and the drilling rig. The apparatus comprises: an elongated boom mounted substantially parallel to the longitudinal axis of the platform mounted on a transverse elevated horizontal beam situated above the proximal end of the platform relative to the drilling rig and to one side of the longitudinal axis thereof, wherein the boom is position adjustable both axially and transversely on the elevated beam as well as angularly within a vertical
(Continued)

plane perpendicular to the elevated horizontal beam; and a drill rod and winch cable guiding means longitudinally movable along said boom.

19 Claims, 7 Drawing Sheets

(51) Int. Cl.

| | |
|---|---|
| ***E21B 19/16*** | (2006.01) |
| ***E21B 19/24*** | (2006.01) |
| ***E21B 15/00*** | (2006.01) |
| ***E21B 19/00*** | (2006.01) |
| ***E21B 19/06*** | (2006.01) |
| *E21B 17/042* | (2006.01) |

(52) U.S. Cl.
CPC ..... *E21B 19/14* (2013.01); *E21B 19/15* (2013.01); *E21B 19/161* (2013.01); *E21B 19/24* (2013.01); *E21B 17/042* (2013.01)

(56) References Cited

U.S. PATENT DOCUMENTS

| | | | | |
|---|---|---|---|---|
| 4,202,653 | A | 5/1980 | Moller | |
| 4,226,447 | A * | 10/1980 | Brown | E21B 19/155 173/197 |
| 8,157,495 | B1 * | 4/2012 | Randall | E21B 19/155 414/22.55 |
| 8,469,648 | B2 * | 6/2013 | Orgeron | E21B 19/155 414/22.55 |
| 2005/0103526 | A1 * | 5/2005 | Ayling | E21B 19/15 175/52 |
| 2006/0285941 | A1 * | 12/2006 | Fikowski | E21B 19/155 414/22.54 |
| 2007/0240884 | A1 * | 10/2007 | Fehres | E21B 19/155 166/380 |
| 2013/0266404 | A1 | 10/2013 | Tolman et al. | |
| 2015/0152697 | A1 * | 6/2015 | Gustavsson | E21B 19/15 175/52 |
| 2016/0130890 | A1 * | 5/2016 | Wase | E21B 19/00 175/52 |
| 2018/0216405 | A1 * | 8/2018 | De Mul | E21B 3/02 |

* cited by examiner

SEMIAUTOMATED DRILL ROD HANDLING APPARATUS AND METHOD, HAND-HELD HAUL PLUG SPINNER AND HAUL PLUG COMBINATION AND DRILL ROD HANDLING SYSTEM WITH BOTH

CROSS-REFERENCE TO RELATED APPLICATIONS

This application is a U.S. National Stage entry of PCT Application No. PCT/CL2015/050018, filed on Jun. 15, 2015, which claims priority to AU Application No. 2014204515, filed Jul. 18, 2014. The contents of the foregoing are incorporated by reference.

FIELD OF APPLICATION OF THE INVENTION

The present invention generally relates to a drill rod handling apparatus and method and more specifically to a semiautomated drill rod handling apparatus and method for use in drilling rigs of the type comprising a main winch and a haul plug with adaptor to assemble and disassemble the drill string and to carry drill rods between a drill rod stowage platform or the like and the drilling rig.

The invention further relates to a combination of a hand-held haul plug spinner and a haul plug usable on such a semi-automated rod handling apparatus.

The invention also refers to a drill rod handling system comprising the referred drill rod handling apparatus and combination of a hand-held haul plug spinner and haul plug.

STATE OF THE ART

In rock drilling processes such as diamond core drilling a drill bit is mounted at the bottom of a drill string made up of sections of drill rods or pipes joined by means of threaded connections. Typically drilling rigs come equipped with a mast to support and guide the tool that is used to drill the hole, the mast defining a drill string centerline when the rig is in operation. Drilling rigs further come equipped with a holdback/feed system needed to move the drill string up and down and a rotation unit typically comprised of either a top head drive or chuck drive connected to this feed system.

A central operation of rock drilling is to handle the drill string rods, that is, transporting drill rods between the mast and a rod stowage rack, horizontal platform or magazine of some sort and adding or removing drill rods from the drill string, an operation which is commonly known as "tripping" and where the drill strings are assembled or disassembled in the mast of a drilling rig one joint at a time. These are labor intensive operations and highly susceptible to workers accidents.

Drill rods have a threaded pin (or male) end and an opposite threaded box (or female) end and are usually lifted from the threaded box end. The drill rods are generally stowed in longitudinal multi-layered arrangement on the platform with their threaded box ends aligned at the end of the platform which is proximal to the drilling rig, i.e. which faces the drilling rig.

In diamond core drilling a main winch and haul plug fastened to the end of the winch cable is commonly used to assemble and disassemble the drill strings during the drilling operation and to carry the rods individually from their stowage location to the mast, and vice versa. Haul plugs are solid metal cylindrical elements that have on one end a means of attachment of the hoist cable, such as a lifting eye or lug, and the other, opposite end is configured (by means of a female threaded end) to releasably connect with various adapters, depending of the diameter of the rods. The adapters are in turn generally cylindrical metal elements having threaded ends for respectively screwing into the haul plug and the threaded box end of the drill rods. Screwing and unscrewing the haul plug from the drill rods is normally done through a manual process though in assembling and disassembling the drill string mechanical means are also used, such as a drill rod spinner.

Drill rods are very heavy elements and their ends can be sharp so special techniques are used to prevent injuries to the operators when handling rods. To avoid manpowered handling in carrying the rods individually between their stowage location and the mast, mechanical swiveling and gripping arms have been developed for gripping and moving the drill rods. However, these automated rod handling devices are made up of complex mechanisms and many of them are not stand alone units but especially adapted or integral with the drilling rig, which requires extensive modifications for these mechanisms to be fitted. Also, many of them are significantly slower than the manual means outlined above providing little incentive to adopt them as very few of them take full advantage of the speed and simplicity that a main winch and a haul plug with adaptor provides.

Regarding the prior art documents, there are documents describing apparatuses and systems for handling rods or pipes. For example, the document U.S. Pat. No. 3,991,887 describes an apparatus for moving drill pipes and casing including a frame with a bifurcated mast pivotally secured thereto, hydraulic cylinders for rotating the mast around the frame and winches and cables securable to ends of a drill pipe or casing.

The document US 2013/266404 describes an apparatus and method for handling pipes between a rig floor and a rack of pipe comprising a loading mechanism and a racking mechanism. The racking mechanism comprises a pair of elevators having a pipe rest said pipe rest being movable between a hold position and a release position.

The document WO 2006/038790 describes a tubular handling apparatus for moving tubulars between two transfer stations. The apparatus includes a base and a boom rotatable with respect to the base, rotation drive means and a gripper rotatable attached to the boom.

The document U.S. Pat. No. 4,202,653 describes a pipe handling system having a swing crane and a bridge crane. The system includes a piggyback riser, a casing skate, spin rolls and a modular stabber.

Nevertheless, none of said documents, alone or in combination, can solve the problem of providing stand alone units capable of handling rods in a fast and safe way.

OBJECTIVES OF THE INVENTION

It is an aim of the invention to provide a semi-automated drill rod handling apparatus wherein the above-mentioned problems are addressed and are at least partly solved.

In this respect, it is a first aim of the invention to provide a semi-automated drill rod handling apparatus adapted to be used with drilling rigs of the type comprising a main winch and haul plug for vertically assembling and disassembling drill strings and to raise and lower drill rods from the mast, wherein the apparatus is simple, safe, quick and economical to operate and it is also simple and economical to manufacture.

Moreover, it is desired that the apparatus of the invention may also be transportable and mountable as an independent, i.e. free-standing or autonomous, unit without requiring any modification to the drilling rig. Notably, it is desired that the apparatus may be mountable on a drill rod jack up platform, although it should also be capable of being mounted to any adequate adjacent structure thereto.

Furthermore, it is an aim of the invention that the semi-automated drill rod handling apparatus can be used with both top head drive and chuck drive drilling rigs and is well-suited to tripping operations in both angled holes as well as vertical holes.

An additional goal of the present invention is to provide a hand-held haul plug spinner and haul plug combination with which manual screwing and unscrewing of the haul plug from the drill rods is eliminated, especially when raising and lowering drill rods from the mast and in this case particularly for use with a semi-automated drill rod handling apparatus such as the one referred to above, but also in the assembly/disassembly of the drill string if there are no automated mechanical means available, enabling in this manner a safe and consistent tightening of the haul plug to the drill rods with a minimum of manual effort.

A further aim of the invention is to provide a drill rod handling system comprising the above-mentioned semi-automated drill rod handling apparatus together with the also above-mentioned hand-held haul plug spinner and haul plug combination.

A final objective of the invention is to provide a drill rod handling method which may be simple, easy, safe and economical to lift and lower drill rods in semi-automated form from the mast of a drilling rig of the type comprising a main winch and haul plug for such operation and for vertically assembling and disassembling drill strings.

SUMMARY OF THE INVENTION

The semi-automated drill rod handling apparatus of the invention is, as already mentioned, adapted to be used with a drilling rig of the type having a main winch and haul plug with adapter for assembling and disassembling the drill string and for carrying drill rods between the drilling rig and a drill rod stowage platform. As is common, the drilling rig has a mast defining a drill string centerline and the platform is positioned next to the drilling rig with a proximal end relative to the drilling rig and a distal end relative to the drilling rig.

The semi-automated drill rod handling apparatus comprises the following main elements:

an elongated boom mounted substantially parallel to the longitudinal axis of the platform on a transverse elevated horizontal beam situated above the proximal end of the platform and to one side of the longitudinal axis thereof, wherein the elongated boom is position adjustable both axially and transversely on the elevated horizontal beam as well as angularly within a vertical plane perpendicular to the elevated horizontal beam; and a drill rod and winch cable guiding means longitudinally movable along said elongated boom to assist in carrying the drill rods between the drilling rig and the platform in combination with the main winch and the haul plug screwed to the box end of the drill rod.

Where a substantially rectangular jack up platform is provided comprising jack legs in each corner, the platform is disposed next to the drilling rig with a first or proximal end relative to the drilling rig and a second or distal end relative to the drilling rig, the elevated horizontal beam is preferably mounted sticking out in cantilever from one of the jack legs located at the first end of the platform. Alternatively, the elevated beam may be supported on a separate vertical pole or column structure positioned adjacent to one side of the platform and close to, or substantially at, the proximal end of the platform.

To adjust the position of the elongated boom in the axial direction of the elevated beam, the apparatus may have incorporated means to move the elongated boom in said axial direction and to lock it in place on the elevated horizontal beam when it reaches the desired position. Alternatively, the elongated boom may be rigidly coupled to the elevated horizontal beam and the jack leg, or the separate structure, depending on which element the elevated horizontal beam is supported on, may comprise means to be moved in said direction and locked in place when the elongated boom reaches the desired position for the semi-automated drill rod handling apparatus to operate as designed.

The drill rod and winch cable guiding means advantageously comprises a grooved traveling roller movable along the elongated boom of the apparatus, wherein the grooved traveling roller is dimensioned and shaped for slidably receiving the drill rod and winch cable over it. In particular, the grooved traveling roller is mounted on a carriage slidable on the elongated boom. A hydraulic motor and chain assembly is preferred as driving means for the drill rod and winch cable guiding means. However, other driving means may also be used, such as a hydraulic cylinder or a rack and pinion type system.

The apparatus may include a crane to respectively load or unload rods from the platform. Also the platform may be track mounted and self propelled for ease of installation in the field and for transport on a support truck.

The apparatus is designed to transport drill rods to and from a defined range or vicinity of the longitudinal axis of the platform. Therefore rods which are lying closer to the sides of the platform or require to be carried to said place must be manually transported (rolled) to and from said vicinity of the longitudinal axis. Consequently, the platform may comprise an automated drill rod shifter mechanism to effect this operation.

In another embodiment of the invention, a hand-held haul plug spinner and haul plug combination is provided.

The haul plug is essentially similar to existing models in that it has a substantially cylindrical body with a male or pin threaded end for screwing into the threaded box end of a drill rod and an opposite end with a lifting eye or lug element axially protruding therefrom for connection with a winch cable. However, the haul plug of the invention further includes a central body portion which has an outer surface adapted for mechanical engagement thereto. Preferably, the central body portion has a longitudinally splined outer surface.

The haul plug spinner comprises, on one end, gripper means for gripping a drill rod and, on the opposite end, it has rotation means for engaging the haul plug and rotating it to screw or unscrew the plug from a drill rod. Desirably the gripper means comprises a pair of opposing pivotal rod gripping jaws and the rotation means comprises a set of opposing gears with teeth set to mesh with the splines of the central body portion of the haul plug. A pair of handles extends from each side of the spinner's body to manipulate it and on the top part it has a lug for suspending it from a suitable structure on or next to a drill rod stowage and feed facility for a drilling rig.

When not in use the haul plug spinner is kept resting clear off the line of travel of the drill rods as they are transported between the platform where they are stowed and the mast. In operation, after the haul plug is moved to a position aligned and in contact with the threaded box end of a selected stowed drill rod on the platform, which is going to be lifted to the mast, or which has just been lowered down to the platform from the mast, the spinner is then manually moved from its resting position onto the haul plug and selected rod where it is first actuated to grip the drill rod with the pair of jaws and secondly to rotate the hauling plug in relation to the drill rod by means of engaging the gears with the splined outer surface of the hauling plug. The gears of the spinner are preferably rotated by means of hydraulic motors resulting in the screwing in and tightening of the haul plug to the drill rods, or vice versa, the loosening and unscrewing of the haul plug as required.

The invention also includes a rod handling system comprising the above-defined semi automated rod handling apparatus and the above-defined hand-held spinner and haul plug combination, wherein the hand-held haul plug spinner is suspended and it is swingable on a balancing and suspension mechanism.

In a preferred embodiment of the invention, the balancing and suspension mechanism comprises a pivoting support arm and a tensioned cable. The balancing and suspension mechanism is disposed on a side of the platform opposite to the elongated boom with respect to the longitudinal axis of the platform and it is movable at least in the direction transverse to the longitudinal axis of the jack up platform to provide a predefined work area for the haul plug spinner and sufficient clearance for the drill rods to be lifted from, and lowered to, the platform. The tensioned cable is fixed from one end to the pivoting arm while the other end has a hook to hold the haul plug spinner: The tensioned cable makes the tool essentially weightless and very easy to handle. The pivoting arm can be supported on a jack leg at the first end of the platform or else it can be supported on a vertical pole or column structure affixed to the side of the jack up platform.

It should be understood that instead of the pivoting arm another appropriate structure could also be used to enable the haul plug spinner to suspend from a tensioned cable and to move between an operative position and a resting position clear off the line of travel of the drill rod. For example, an elevated horizontal beam assembly could be provided with a roller movable thereon to which the tensioned cable can be joined.

The main actuatable elements of the apparatus (elongated boom positioning means, carriage), and the spinner gears and jaws of the hand-held spinner are commonly hydraulically powered and are controlled from an operator's console linked to the platform or a remote control.

In preparing the apparatus for operation, first the position of the elongated boom is adjusted on the elevated horizontal beam so that, in combination with the position of the platform next to the drilling rig, the drill rod and winch cable guiding means at maximum travel towards the drill mast along the elongated boom enables the assembly or disassembly of the drill string with the winch and haul plug. Basically the adjustment is such that in said maximum travel position of the drill rod and winch cable guiding means a drill rod being handled by the apparatus and passed over the groove of the traveling roller should be aligned with the center line of the drill string.

To carry a drill rod from the platform to the mast of the drilling rig, first the main winch cable with haul plug and required adaptor attached to the end thereof have to be passed through the grooved traveling roller of the drill rod and winch cable guiding means which is positioned vertically above the box end of the drill rods. The haul plug adapter is then screwed into the box end of a drill rod which is centrally positioned on top of the multi-layered arrangement of drill rods on the platform, that is, which is in the vicinity of the longitudinal axis of the platform. In a preferred embodiment of the invention this step is carried out with the assistance of the hand-held haul plug spinner of the invention in the way previously described.

Once the haul plug is completely tightened to the drill rod, the main winch of the rig is actuated to pull and simultaneously lift the drill rod from the platform, box end first, passing it over the winch cable and drill rod guiding means which is suitably moved along the elongated boom to maintain contact with the drill rod at all times until the drill rod is lifted to a point where, with the winch cable and drill rod guiding means moved fully towards the mast up to the point of maximum travel along the elongated boom, the drill rod is aligned for assembly with the drill string.

For lowering the drill rods from the drilling rig, the steps are the same but in the reverse order.

To facilitate the understanding of the precedent ideas, the invention is described making reference to the attached drawings.

DETAILED DESCRIPTION OF THE INVENTION

Figure 1:
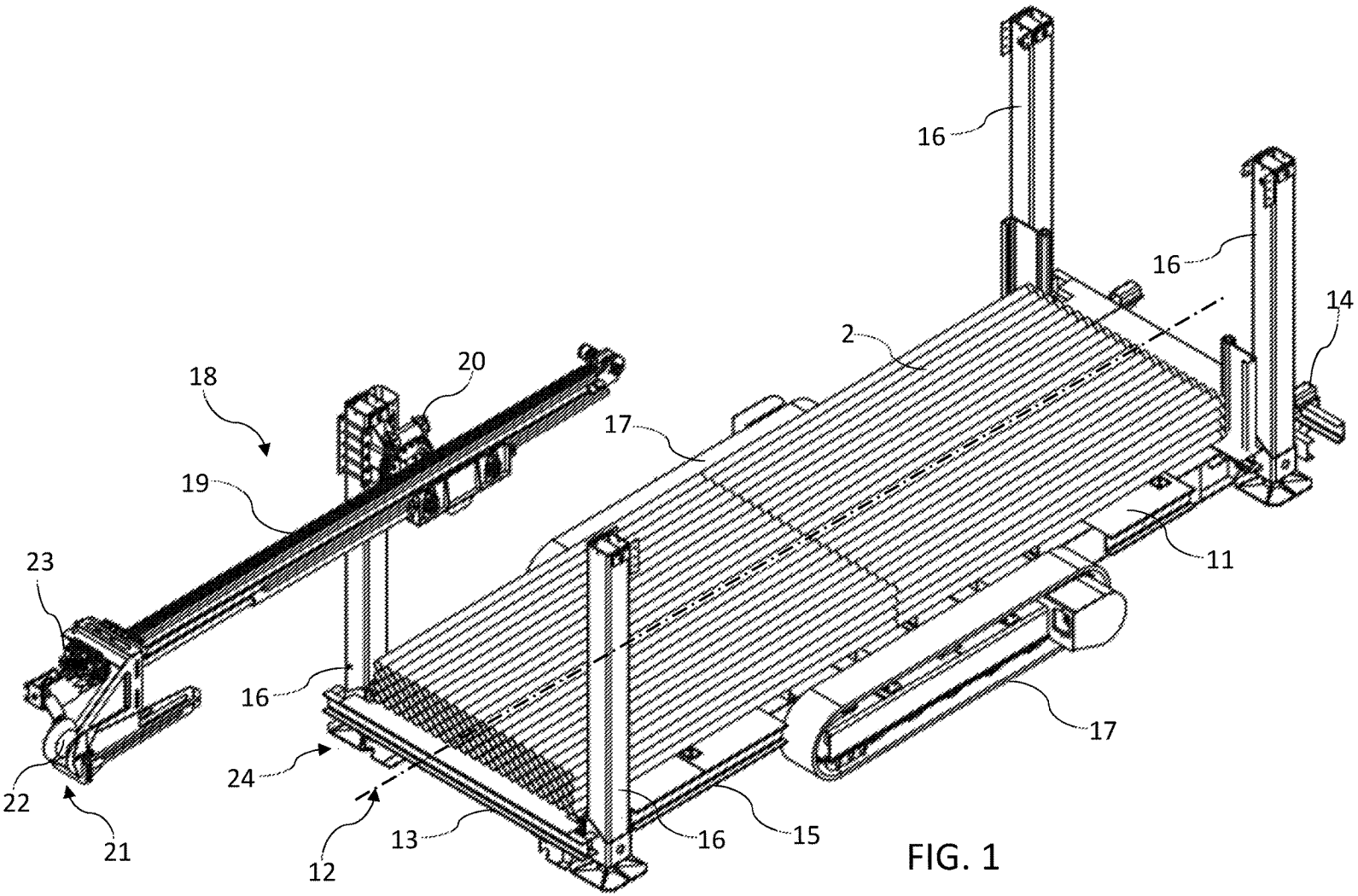
FIG. 1 depicts an isometric view of the semiautomated drill rod handling apparatus of the invention specifically showing the disposition of different elements when not in use.
Figure 2:
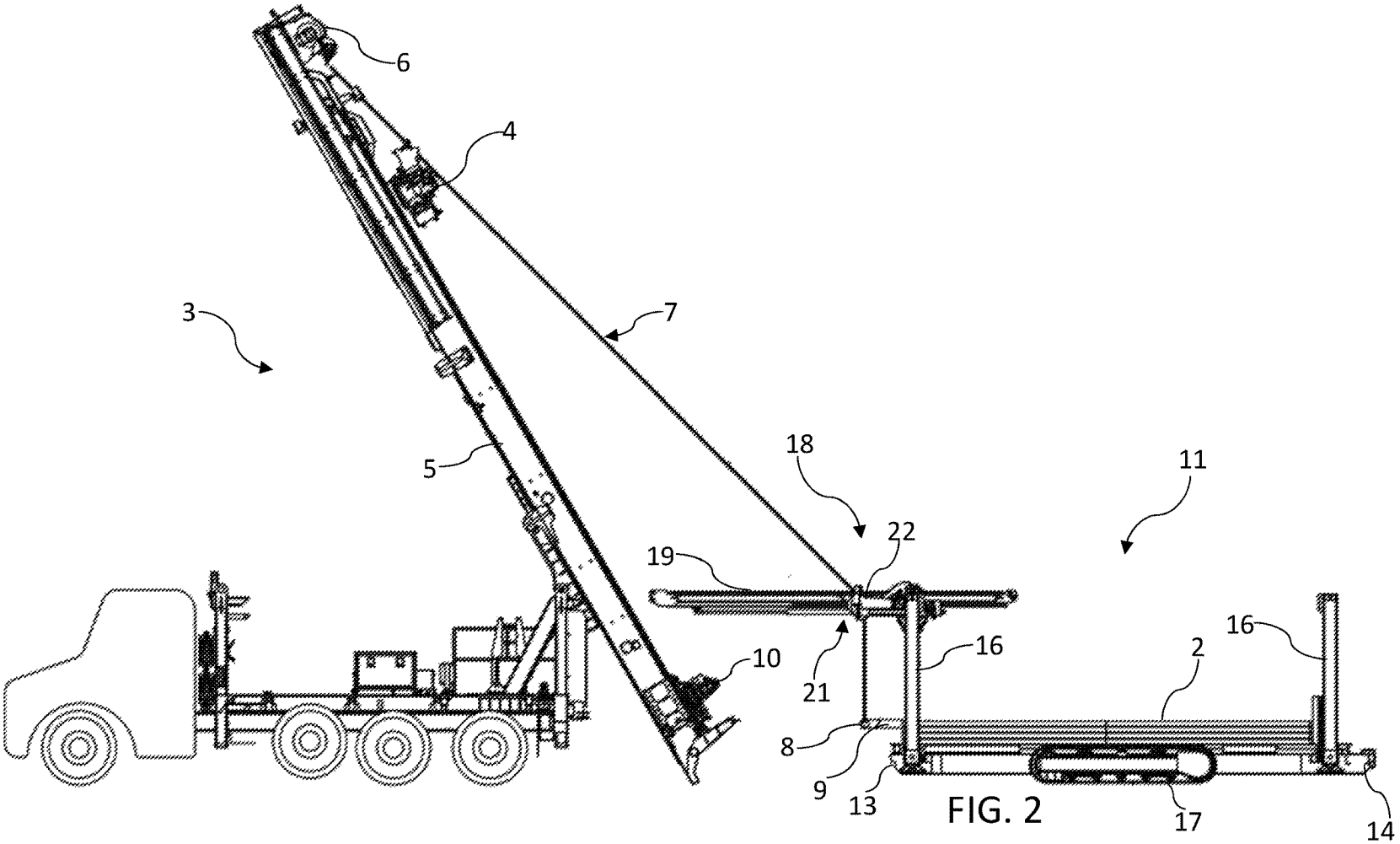
FIG. 2 depicts a side elevation view of the semiautomated drill rod handling apparatus of the invention when it is in operation lifting a drill rod from the jack up platform to carry it to the mast of a drilling rig, specifically showing the stage when a drill rod is connected with the haul plug and winch cable which are passed over the drill rod and winch cable guiding means.
Figure 3:
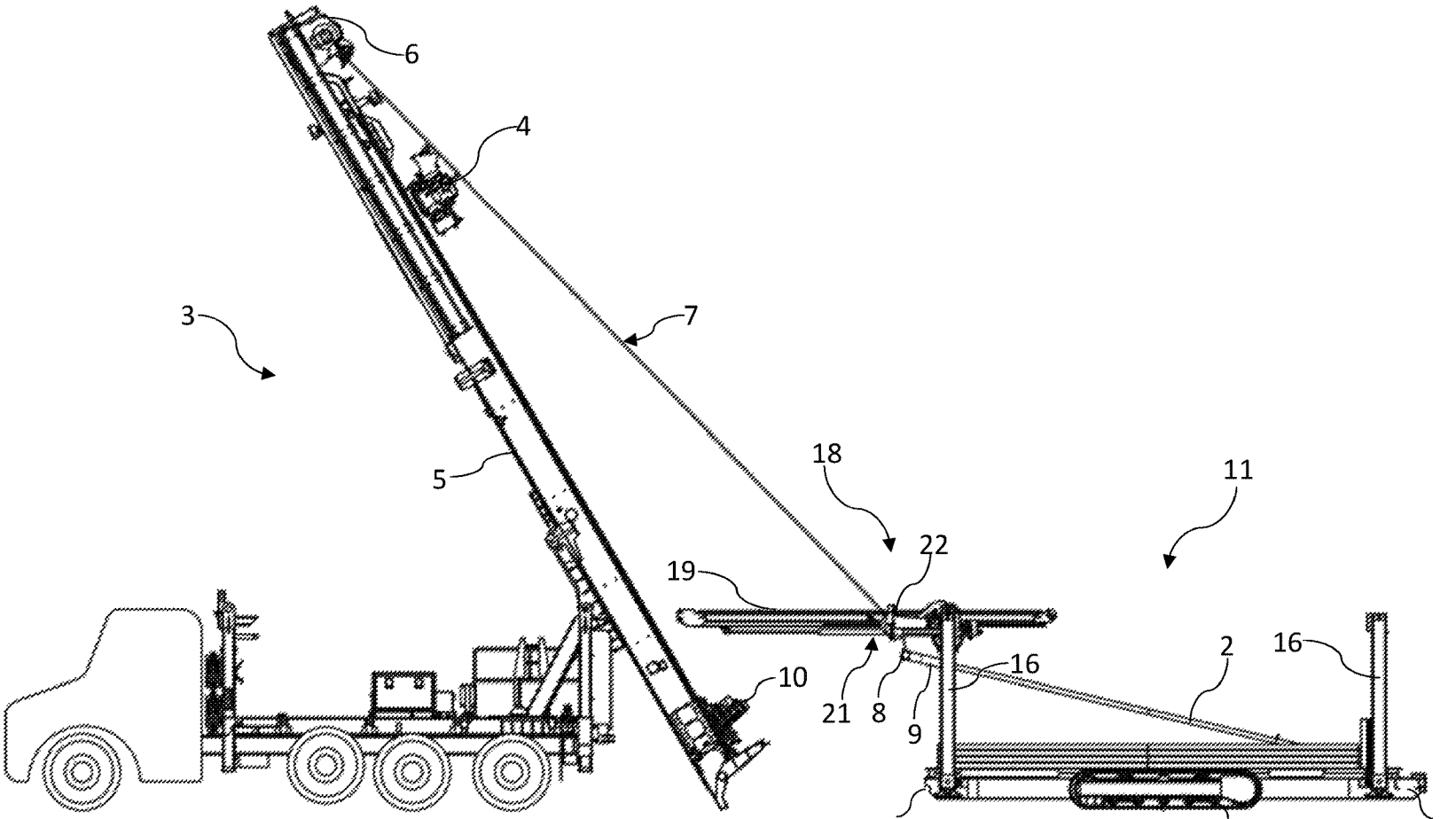
FIG. 3 depicts the system of FIG. 2 specifically showing the stage when the drill rod is being lifted further from the jack up platform and inclined upwardly.
Figure 4:
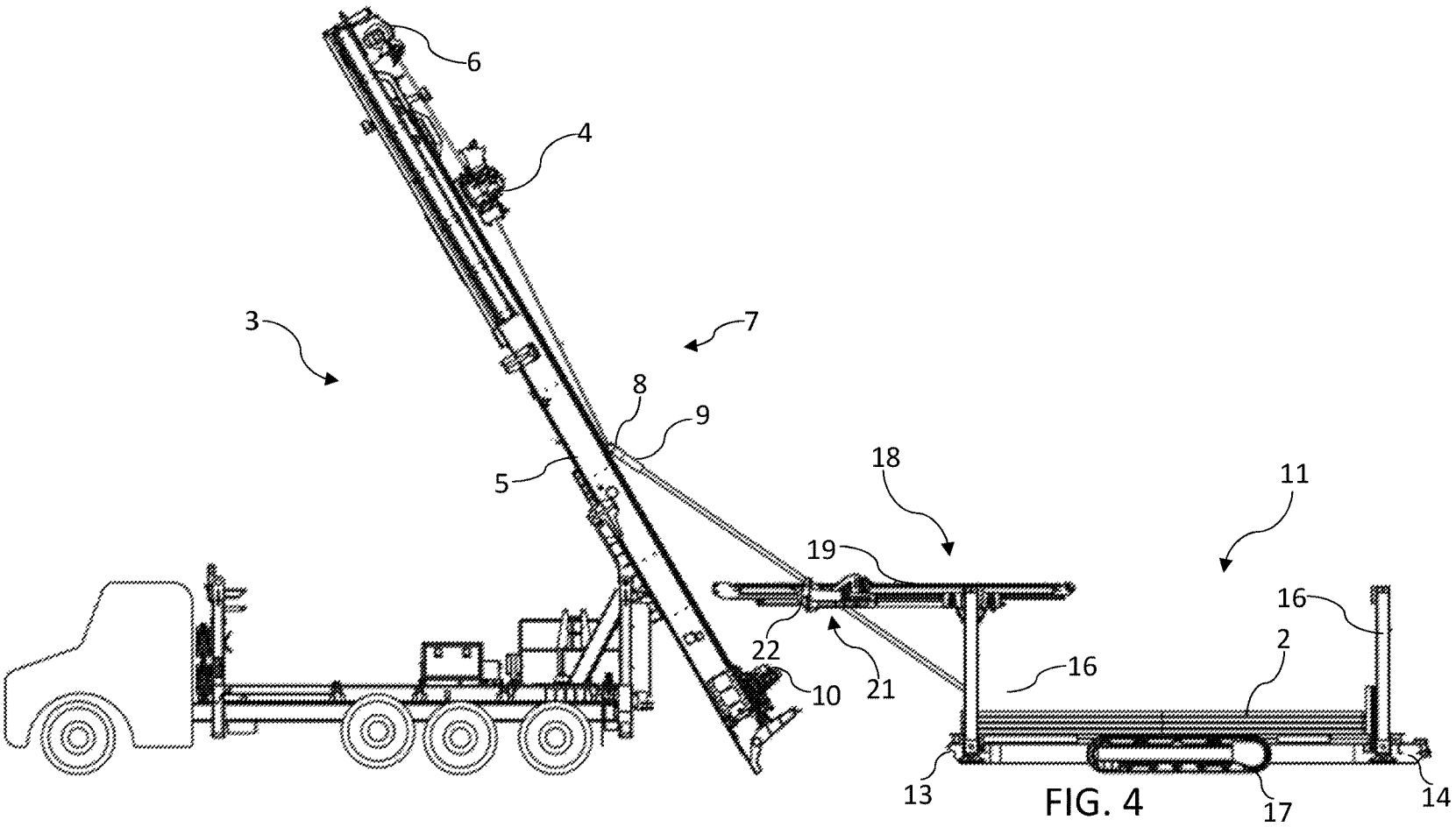
FIG. 4 depicts the system of FIG. 2 specifically showing the stage when the drill rod is being lifted and inclined upwardly even further and it is positioned on the drill rod and winch cable guiding means, which has moved along the elongated boom to maintain contact at all times with the drill rod, the drill rod actually being about to be lifted clear off the platform and the haul plug reaching a point where it rests on the mast of the rig.
Figure 5:
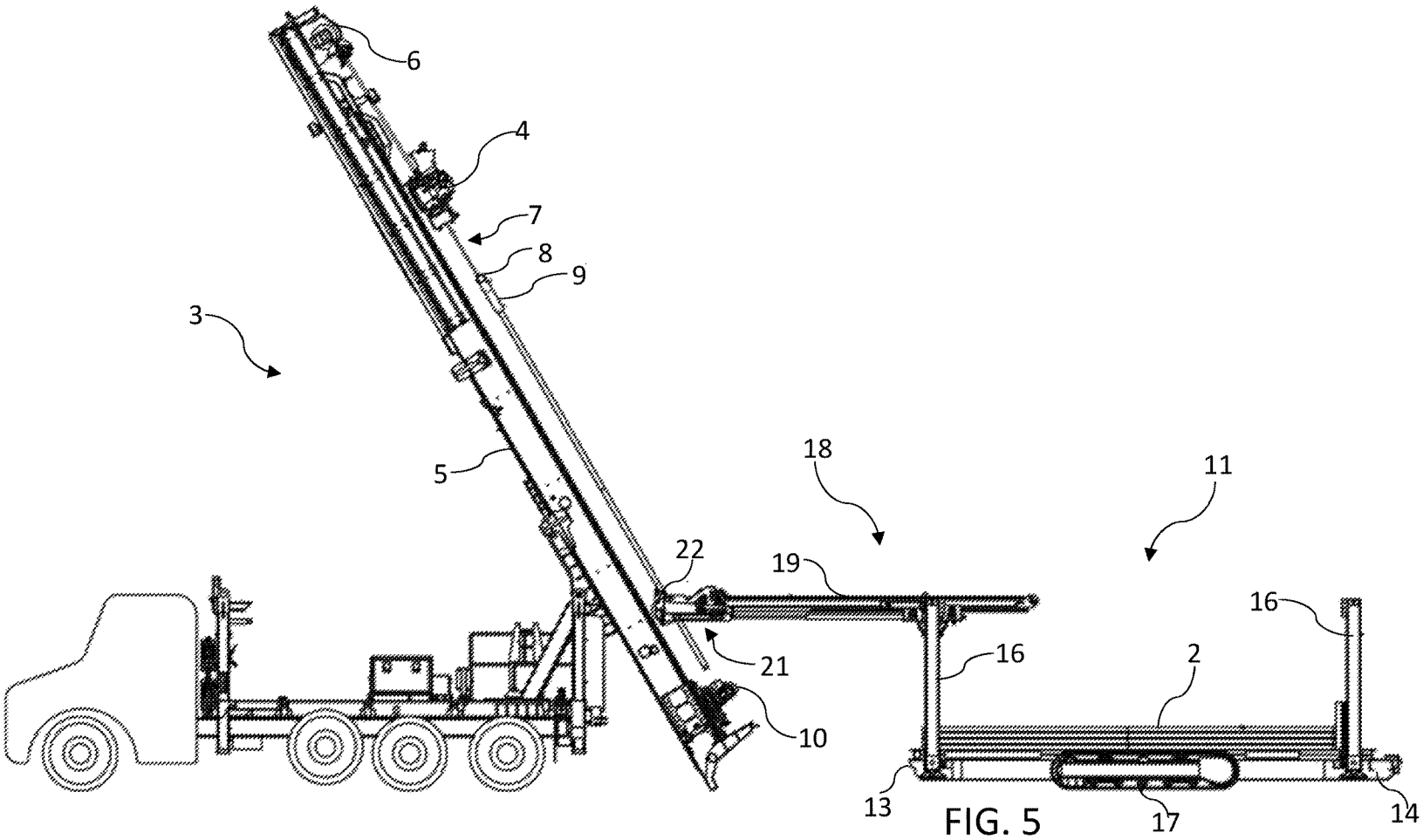
FIG. 5 depicts the system of FIG. 2 specifically showing the stage when a drill rod has reached a final position in the mast and it is about to be connected to the driving head of the drilling rig.

Referring to the figures, an exemplary embodiment of the invention is shown where the following constituent elements are distinguished:

drill rod handling system 1 drill rods 2
drilling rig 3
top drive 4
mast 5
main winch 6
winch cable 7
haul plug 8
adapter 9
rod spinner 10
platform 11
longitudinal axis 12
first or proximal end of the platform 13
second or distal end of the platform 14
side of the platform 15
jack legs 16
tracks 17
drill rod handling apparatus 18
elongated boom 19
elevated horizontal beam 20
drill rod and winch cable guiding means 21
grooved traveling roller 22
carriage 23
hand-held haul plug spinner 24
gears 25
jaws 26
handle 27
lug 28
balancing and suspension mechanism 29
pivoting support arm assembly 30
tension cable 31
splines 32

In FIG. 1 a jack up platform 11 is depicted resting on four jack legs 16, one in each corner, and has a number of drill rods 2 stowed in multi-layer arrangement o the top deck thereof. The platform shown is mounted on tracks 17 and it is self propelled for ease of installation in the field and for transport on a support truck. However this may not necessarily the case as the invention can be used with any suitable drill rod platform self propelled or not.

The elongated boom 19 of the semi-automated drill rod handling apparatus 18 of the invention is supported on a transverse elevated horizontal beam 20 which sticks out in cantilever manner from one of the jack legs 16 of the first end 13 of the jack up platform 11. The drill rod and winch cable guiding means 21 of the apparatus are comprised of a grooved traveling roller 22 mounted on a carriage 23 which slides along the elongated boom 19.

With reference to FIGS. 2 to 5 the drill rod handling apparatus 18 according to the invention is shown in operation with drilling rig 3 having a top drive 4. As required by the invention, the drilling rig 3 further has a main winch 6 and a haul plug 8 with adapter 9. In the exemplary embodiment of the invention shown in the figures the drilling rig comprises a drill mast 5 mounted on a truck, wherein the mast has mounted thereon a rod spinner 10 for the tripping operation and defines a drill string centerline therefore (not shown).

The elongated jack up platform 11 of the figures is placed for operation with its first end 13 next to the drilling rig 3, the drill rods 2 being stowed in the platform in longitudinal multi-layered arrangement with the box end of the drill rods at the proximal end of the platform, facing the drilling rig 3. First, the elongated boom 19 is adjusted into position on the elevated horizontal beam 20 such that, in conjunction with the position of the platform 11 next to the drilling rig 3, the drill rod and winch cable guiding means 21 at maximum travel towards the drill mast 5 along the elongated boom 19 is aligned with the drill string centerline to enable the assembly of the drill string. Then, the main winch cable 7 with haul plug 8 and required adaptor 9 from the drilling rig 3 is passed over the grooved traveling roller 22 of the winch cable and drill rod guiding means 21.

To carry a drill rod from the platform to the mast of the drilling rig, the following steps are carried:

1. The winch cable and drill rod guiding means 21 is initially positioned vertically above the proximal end of the platform. The haul plug 8 with the adapter 9 is then screwed into the box end of a drill rod which is centrally positioned on top of the multi-layered arrangement of drill rods on the platform (FIG. 2).
2. Once the haul plug 8 is completely tightened the main winch 6 is actuated so that the selected drill rod 2 is lifted from the platform 11 by the box end of the rod (FIG. 3) until the haul plug and drill rod passes over the groove of the traveling roller 22 of the winch cable and drill rod guiding means 21 and then it is further lifted while simultaneously pulled towards the mast by the main winch so as to carry the drill rod to the drilling rig. Such operation is carried out in collaboration with the winch cable and drill rod guiding means 21 moving along the elongated boom 19 towards the drilling rig as required to support and maintain contact with the drill rod at all times.
3. The main winch 6 continues to pull and lift the drill rod until the haul plug makes contact with the drilling rig mast (FIG. 4) and the drill rod has been lifted clear off the platform, leaving it solely suspended from the winch cable 7 and supported on the winch cable and drill rod guiding means 21.
4. As the main winch 6 continues to lift up and pull the drill rod, the winch cable and drill rod guiding means 21 is gradually moved fully towards the mast 5 to the point of maximum travel along the elongated boom 19, which will align the drill rod 2 with the drill string centerline for assembly with the drill string (FIG. 5).
5. In assembling the drill rod with the drill string, the drill rod is lowered in the mast by means of the main winch 6 and it is screwed at its pin threaded end into the existing drill string by means of the drill rod spinner 10. The drill rod 2 is then further lowered past the winch cable and drill rod guiding means 21 together with the drill string descending into the hole so that the haul plug 8 with adapter 9 can be removed by the drill rod spinner 10 or other means. Subsequently, the haul plug 8 with adapter 9 is lifted by the main winch 6 and repositioned vertically above the proximal end of the platform 11 for another rod to be carried from the platform to the drilling rig.

This process is repeated as many times as necessary.

To carry the drill rods from the drilling rig to the platform, the reverse procedure is carried out as explained below:

1. First the winch cable and drill rod guiding means 21 is positioned at the point of maximum travel along the elongated boom towards the mast with the main winch cable with haul plug and required adaptor passed over the grooved traveling roller. The winch cable and haul plug with adapter is lowered and screwed into the box end of the drill rod which is at the top of the drill string with the assistance of the drill rod spinner 10.
2. The drill rod 2 is then raised with the main winch until it can be unscrewed from the drill string with the drill rod spinner 10 or other means. Once unscrewed, it is lifted up clear from the drill string to a height where it is supported on the traveling roller.

3. Subsequently the drill rod is lowered and carried to the jack up platform with the main winch holding the box end of the rod and the winch cable and drill rod guiding means 21 moving along the elongated boom in the direction of the platform, the winch cable and drill rod guiding means pulling the rod towards the platform in the process. During this process, the haul plug makes contact with the drilling rig mast while the drill rod is suspended from the haul cable and supported on the winch cable and drill rod guiding means 21. Then the rod is moved clear away from the drilling rig mast as the pin end of the drill rod approaches the platform and eventually drops by gravity to the platform. Throughout this stage the traveling roller is moved along the elongated boom 19 towards the jack up platform as required so as to maintain contact with the drill rod at all times.
4. Once the threaded pin end of the drill rod drops to the platform (or top of the drill rods already stowed thereon) the rod will slide by gravity towards the second or distal end of the platform until the traveling roller reaches the point where it is vertically above the proximal end of the platform, the pin end of the drill rod reaches said second end of the platform and the rod finally completely drops to the platform.
5. With the drill rod fully resting on the platform the haul plug and required adaptor is unscrewed and then the winch cable and haul plug is repositioned on the mast for the next rod at the top of the drill string by means of the winch cable and drill rod guiding means 21 moving back towards the mast.

Figure 6:
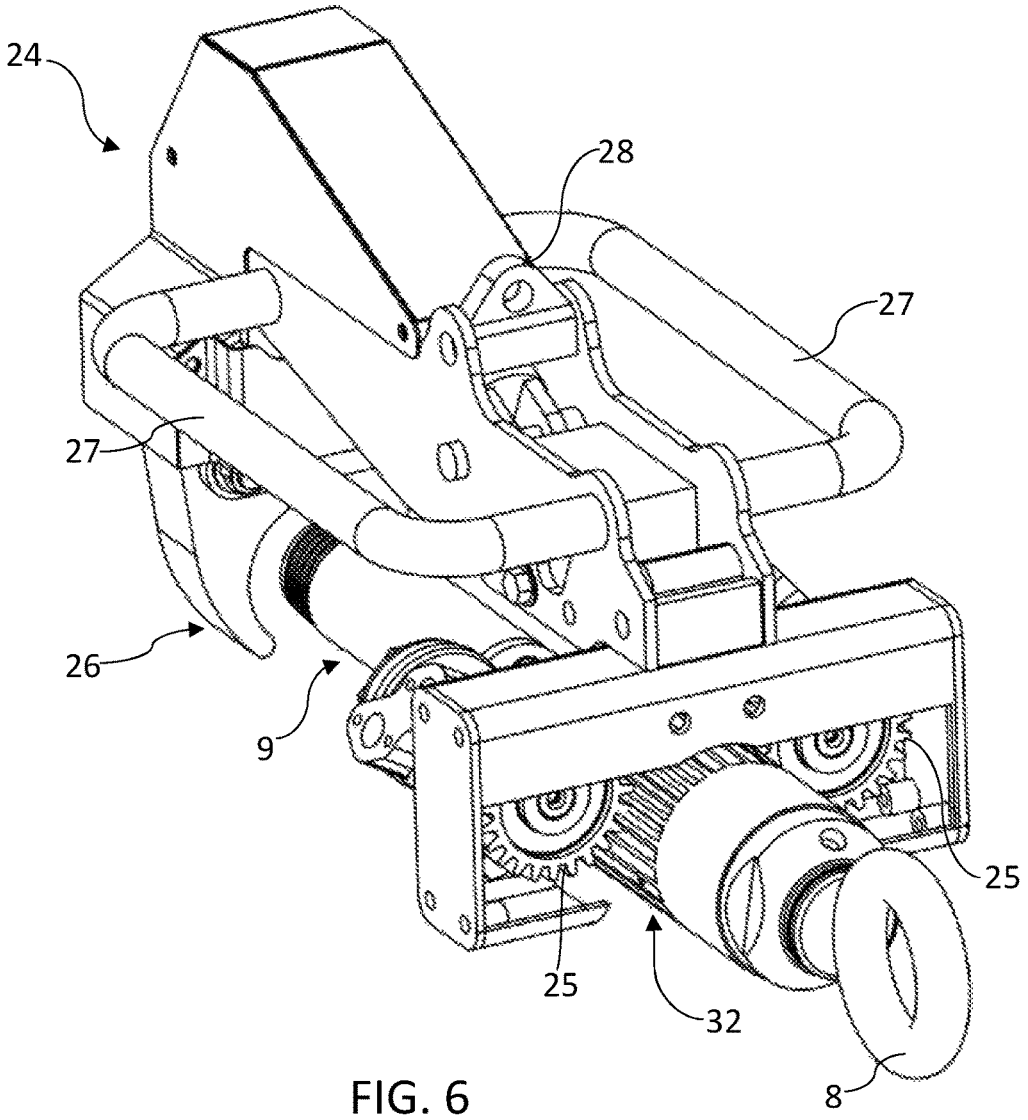
FIG. 6 depicts an isometric view of a haul plug spinner and haul plug combination according to the invention.

In FIG. 6, an exemplary model of hand-held haul plug spinner 24 and haul plug 8 combination according to the invention is depicted with an adapter 9 attached to the haul plug 8. The gears 25 of the spinner are engaging the splines 32 of the haul plug 8 and the jaws 26 of the spinner are open and ready to grip a drill rod. The handles 27 serve to manipulate the spinner from a resting position to and an operative position to screw or unscrew the haul plug from a drill rod. The spinner is able to be suspended from a suitable structure by the lug 28 it has on its top part.

Figure 7:
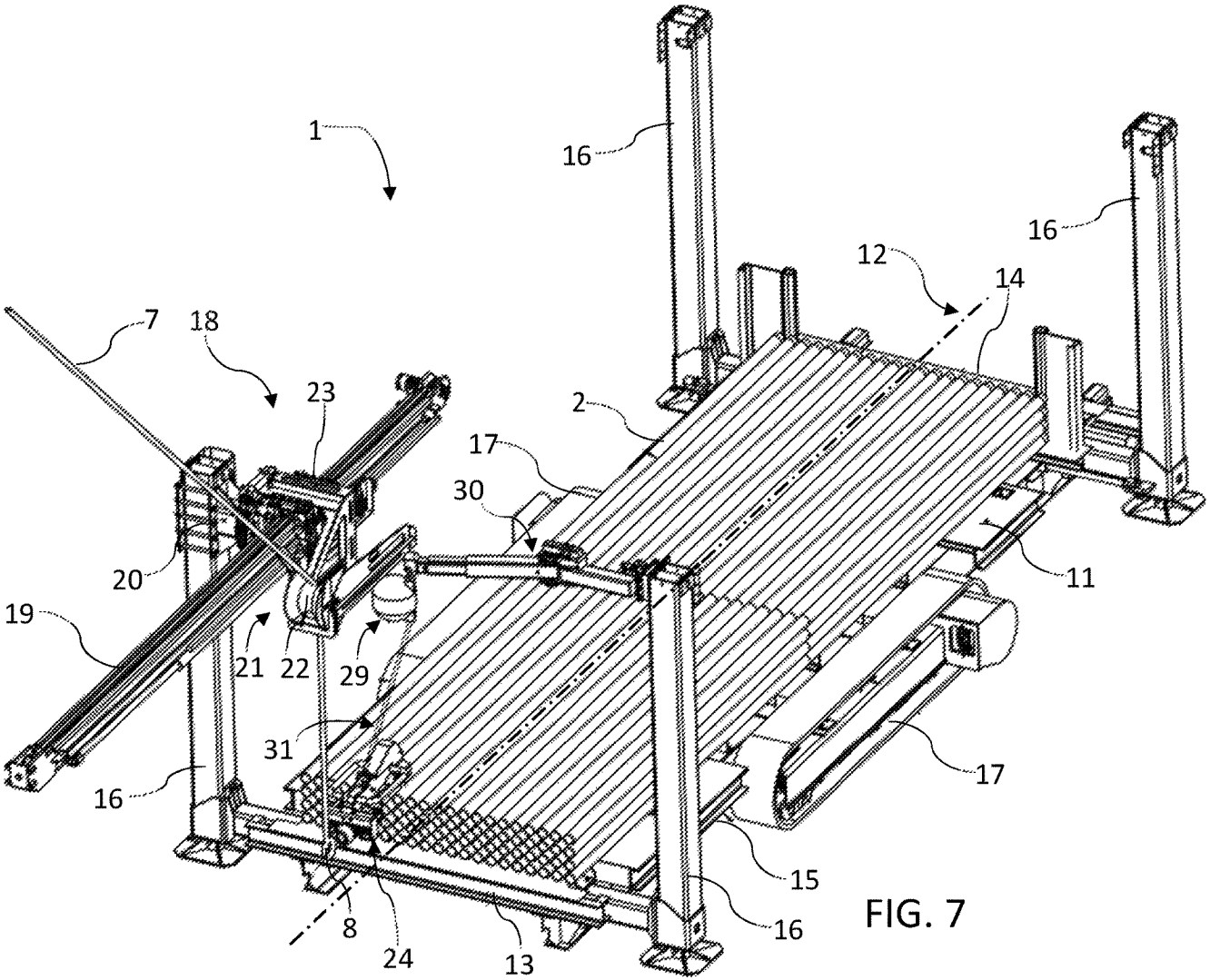
FIG. 7 depicts an isometric view of the drill rod handling system of the invention specifically showing the disposition of different elements when a drill rod is being engaged with the haul plug spinner and haul plug combination of the invention.

As can been seen in FIG. 7 showing the rod handling system 1 according tom the invention, a pivoting support arm assembly 30 for suspending the haul plug spinner 24 is shown mounted on the opposite side of the platform 11 where the elongated boom is mounted. This arm assembly 30 is able to move, at least, in a horizontal plane at a set height above the platform enabling the haul plug spinner 24 to be positioned and used where required. However, other structures for supporting the spinner may also be used without parting from the principles of the present invention.

While the described hand-held haul plug spinner and a haul plug combination is usable on a semi-automated rod handling apparatus such as the one of the invention, it could also be used in general to handle drill rods in other rod handling devices and drilling rigs of the type which use a main winch and a haul plug with adaptor.

The invention claimed is:

1. A semi-automated drill rod (2) handling apparatus (18) for a drilling rig (3) of the type having a mast (5) defining a drill string centerline and a main winch (6) and haul plug (8) with adapter (9) for assembling and disassembling the drill string and carrying drill rods (2) which have a threaded pin end and an opposite threaded box end between a drill rod stowage platform(11) positioned next to the drilling rig (3) and the drilling rig (3), the platform (11) having a longitudinal axis (12), a proximal end (13) relative to the drilling rig, a distal end (14) relative to the drilling rig (3), two sides and four corners, wherein the drill rods (2) are stowed in the platform (11) in a longitudinal multi-layered arrangement with their threaded box ends at the proximal end (13) of the platform (11), wherein the apparatus (18) comprises:

an elongated boom (19) mounted parallel to the longitudinal axis (12) of the platform (11) on a transverse elevated horizontal beam (20) situated above the proximal end (13) of the platform (11) and to one side of the longitudinal axis (12) thereof, wherein the boom (19) is position adjustable both axially and transversely on the elevated beam (20) as well as angularly within a vertical plane perpendicular to the elevated horizontal beam (20); and a drill rod (2) and winch cable (7) guiding means (21) longitudinally movable along said boom (19) to assist in carrying drill rods (2) between the drilling rig (3) and the platform (11) in combination with the main winch (6) and the haul plug (8) screwed to the box end of the drill rod (2).

2. The drill rod (2) handling apparatus (18) of claim 1, wherein the platform (11) comprises jack legs (16), and the elevated horizontal beam (20) is supported on a jack leg (16) located at the proximal (13) end of the platform (11).

3. The drill rod (2) handling apparatus (18) of claim 1, wherein the elevated horizontal beam (20) is supported on a separate structure positioned adjacent to one side of the platform (11) and within a defined distance range of the proximal end (13) of the platform (11).

4. The drill rod (2) handling apparatus (18) of claim 1, wherein the drill rod (2) guiding means (21) comprises a grooved traveling roller (22) mounted on a carriage (23) which is slidable along the elongated boom (19).

5. The drill rod (2) handling apparatus (18) of claim 4, wherein the grooved traveling roller (22) is dimensioned and shaped for slidably receiving a drill rod (2) being carried between the drilling rig (3) and the platform (11) and the winch cable (7) over it.

6. The drill rod (2) handling apparatus (18) of claim 1, wherein the apparatus (18) further comprises a crane to load or unload rods (2) onto or from the platform (11).

7. A hand-held haul plug spinner (24) and haul plug (8) combination for use in a drilling rig (3) of the type having a mast (5) defining a drill string centerline and a main winch (6) and haul plug (8) with adapter (9) for assembling and disassembling the drill string and carrying drill rods (2) which have a threaded pin end and an opposite threaded box end between a drill rod (2) stowage platform (11) and the drilling rig (3), wherein:

the haul plug (8) is made up of a substantially cylindrical body having a male threaded end for screwing into the threaded box end of a drill rod (2) and an opposite end with a lifting eye or lug element axially protruding therefrom for connection with a winch cable (7), the haul plug (8) further having a central body portion which has an outer surface adapted for mechanical engagement thereto; and the hand-held haul plug spinner (24) comprises: on one end, gripper means for gripping a drill rod (2) and, on the opposite end, rotation means for engaging the outer surface of the central body portion of the haul plug (8) and rotating the haul plug (8) to screw or unscrew the haul plug (8) from a drill rod (2).

8. The hand-held haul plug spinner (24) and haul plug (8) combination of claim 7, wherein the outer surface of the central body portion of the haul plug (8) comprises longitudinal splines (32) and wherein the gripper means the hand-held haul plug spinner (24) comprises a pair of opposing pivotal rod gripping jaws (26) and the rotation means of the hand-held haul plug spinner (24) comprises a set of opposing gears (25) with teeth set to mesh with the splines of the central body portion of the haul plug (8).

9. A drill rod (2) handling system (1) for a drilling rig (3) of the type having a mast (5) defining a drill string centerline and a main winch (6) and haul plug (8) with adapter (9) for assembling and disassembling the drill string and carrying drill rods (2) which have a threaded pin end and an opposite threaded box end between a drill rod (2) stowage platform (11) and the drilling rig (3), wherein the system (1) comprises:

a rod handling apparatus (18) according to claim 1; and a hand-held haul plug spinner (24) and haul plug (8) combination for use in said drilling rig (3), wherein the haul plug (8) is made up of a substantially cylindrical body having a male threaded end for screwing into the threaded box end of a drill rod (2) and an opposite end with a lifting eve or lug element axially protruding therefrom for connection with a winch cable (7), the haul plug (8) further having a central body portion which has an outer surface adapted for mechanical engagement thereto; and wherein the hand-held haul plug spinner (24) comprises: on one end, gripper means for gripping a drill rod (2) and, on the opposite end, rotation means for engaging the outer surface of the central body portion of the haul plug (8) and rotating the haul plug (8) to screw or unscrew the haul plug (8) from a drill rod (2);

wherein the hand-held haul plug spinner (24) is suspended and it is swingable on a balancing and suspension mechanism (29) which is disposed on the platform (11) opposite to the elongated boom (19) with respect to the longitudinal axis (12) of the platform (11) and which is movable at least in the direction transverse to the longitudinal axis (12) of the platform (11) to provide a predefined work area for the haul plug spinner (24) and clearance for the drill rods (2) to be lifted from, or lowered to, the platform (11).

10. The drill rod (2) handling system (1) of claim 9, wherein the balancing and suspension mechanism (29) for the hand-held haul plug spinner (24) comprises a pivoting arm (30) and a tensioned cable (31), wherein the tensioned cable (31) is fixed from one end thereof to the pivoting arm (30) and the other end of the tensioned cable (31) has a hook to hold the haul plug spinner (24).

11. The drill rod (2) handling system (1) of claim 10, wherein the platform (11) comprises jack legs (16) and the pivoting arm (30) is supported on a jack leg (16) at the proximal end (13) of the platform (11).

12. The drill rod (2) handling system (1) of claim 10, wherein the pivoting arm (30) is supported on a separate vertical pole or column structure affixed to the side of the platform (11).

13. A method of handling drill rods (2) in a drilling rig (3) of the type having a mast (5) defining a drill string centerline and a main winch (6) and haul plug (8) with adapter (9) for assembling and disassembling the drill string and carrying drill rods (2) between the drilling rig (3) and a drill rod (2) stowage platform (11) positioned next to the drilling rig (3), the method comprising:

providing a semi-automated drill rod (2) handling apparatus (18) according to claim 1;

adjusting the position of the elongated boom (19) on the elevated horizontal beam (20) so that in combination with the position of the platform (11) next to the drilling rig (3) the drill rod (2) and winch cable (7) guiding means (21) at maximum travel towards the drill mast (5) along the elongated boom (19) enables the assembly or disassembly of the drill string with the winch (6) and haul plug (8);

with the main winch cable (7) with haul plug (8) and required adaptor (9) passed through a grooved traveling roller (22), positioning the drill rod (2) and winch cable (7) guiding means (21) vertically above the proximal end (13) of the platform (11) and positioning the haul plug (8) with adaptor (9) for screwing into the box end of a selected drill rod (2) from the platform (11);

screwing the haul plug (8) to the selected drill rod (2);

actuating the main winch (6) to lift the selected drill rod (2) from the platform (11), pass it over the traveling roller (22) of the winch cable (7) and drill rod (2) guiding means (21) and subsequently further lift it while simultaneously pulling it towards the mast (5) in collaboration with the winch cable (7) and drill rod (2) guiding means (21) moving along the elongated boom (19) in the direction of the mast (5) so as to support and maintain contact with the drill rod (2) at all times, until the winch cable (7) and drill rod (2) guiding means (21) has moved fully towards the mast (5) up to the point of maximum travel along the elongated boom (19) and the drill rod (2) is aligned with the drill string centerline so the drill rod (2) can be lowered by the main winch (6) for assembly with the drill string.

14. A method of handling drill rods (2) in a drilling rig (3) of the type having a mast (5) defining a drill string centerline and a main winch (6) and haul plug (8) with adapter (9) for assembling and disassembling the drill string and carrying drill rods (2) between the drilling rig (3) and a drill rod (2) stowage platform (11) positioned next to the drilling rig (3), the method comprising:

providing a drill rod (2) handling system (1) according to claim 9;

adjusting the position of the elongated boom (19) on the elevated horizontal beam (20) so that in combination with the position of the platform (11) next to the drilling rig (3) the drill rod (2) and winch cable (7) guiding means (21) at maximum travel towards the drill mast (5) along the elongated boom (19) enables the assembly or disassembly of the drill string with the winch (6) and haul plug (8);

with the main winch cable (7) with the haul plug (8) and required adaptor (9) passed through a grooved traveling roller (22), positioning the drill rod (2) and winch cable (7) guiding means (21) vertically above the proximal end (13) of the platform (11) and positioning the haul plug (8) with adaptor (9) for screwing into the box end of a selected drill rod (2) from the platform (11);

screwing the haul plug (8) to the selected drill rod (2) with the hand-held haul plug spinner (24);

actuating the main winch (6) to lift the selected drill rod (2) from the platform (11), pass it over the traveling roller (22) of the winch cable (7) and drill rod (2) guiding means (21) and subsequently further lift it while simultaneously pulling it towards the mast (5) in collaboration with the winch cable (7) and drill rod (2) guiding means (21) moving along the elongated boom (19) in the direction of the mast (5) so as to support and maintain contact with the drill rod (2) at all times, until the winch cable (7) and drill rod (2) guiding means (21)

has moved fully towards the mast (5) up to the point of maximum travel along the elongated boom (19) and the drill rod (2) is aligned with the drill string centerline so the drill rod (2) can be lowered by the main winch (6) for assembly with the drill string.

15. The method of handling drill rods (2) according to claim 13, wherein assembling the drill rod (2) with the drill string comprises lowering the drill rod (2) along the mast (5) by means of the main winch (6) and screwing it at its pin threaded end into the existing drill string, the drill rod (2) subsequently further lowered past the winch cable (7) and drill rod (2) guiding means (21) together with the drill string descending into the hole so that the haul plug (8) with adapter (9) can be removed from the box end of the drill rod (2).

16. The method of handling drill rods (2) according to claim 15, wherein after assembling the drill rod (2) with the drill string and the haul plug (8) with adapter (9) is removed from the box end of the drill rod (2) the haul plug (8) with adapter (9) is lifted by means of the main winch (6) and repositioned for the next rod of the platform (11) by moving the winch cable (7) and haul plug (8) guiding means (21) vertically above the proximal end (13) of the platform (11) with the winch cable (7) and haul plug (8) passed over the grooved traveling roller (22).

17. A method of handling drill rods (2) in a drilling rig (3) of the type having a mast (5) defining a drill string centerline and a main winch (6) and haul plug (8) with adapter (9) for assembling and disassembling the drill string and carrying drill rods (2) between the drilling rig (3) and a drill rod (2) stowage platform (11) positioned next to the drilling rig (3), the method comprising:

providing a semi-automated drill rod (2) handling apparatus (18) according to claim 1;

adjusting the position of the elongated boom (19) on the elevated horizontal beam (20) so that in combination with the position of the platform (11) next to the drilling rig (3) the drill rod (2) and winch cable (7) guiding means (21) at maximum travel towards the drill mast (5) along the elongated boom (19) enables the assembly or disassembly of the drill string with the winch (6) and haul plug (8); with the drill rod (2) and winch cable (7) guiding means (21) positioned at said point of maximum travel towards the mast (5) and the main winch cable (7) with haul plug (8) and required adaptor (9) passed through a grooved traveling roller (22) thereof;

lowering the haul plug (8) with adaptor (9) for screwing into the box end of the drill rod (2) which is at the top of the drill string;

screwing the haul plug (8) to the drill rod (2);

actuating the main winch (6) to lift the drill rod (2), remove it from the drill string and further lift it so it makes contact with the grooved traveling roller (22) of the drill rod (2) and winch cable (7) guiding means (21);

lowering and carrying the drill rod (2) from the mast (5) to the platform (11) with the main winch (6) holding the box end of the rod (2) and the winch cable (7) and drill rod (2) guiding means (21) moving along the elongated boom (19) in the direction of the platform (11), the winch cable (7) and drill rod (2) guiding means (21) pulling the rod (2) towards the platform (11) in the process while maintaining contact with the drill rod (2) at all times until it reaches a point vertically above the proximal end (13) of the platform (11), the threaded pin end of the drill rod (2) dropping and sliding by gravity towards the distal end (14) of the platform (11) until the drill rod (2) finally completely drops to the platform (11); and unscrewing the haul plug (8) with adaptor (9) from the drill rod (2).

18. A method of handling drill rods (2) in a drilling rig (3) of the type having a mast (5) defining a drill string centerline and a main winch (6) and haul plug (8) with adapter (9) for assembling and disassembling the drill string and carrying drill rods (2) between the drilling rig (3) and a drill rod (2) stowage platform (11) positioned next to the drilling rig (3), the method comprising:

providing a drill rod (2) handling system (1) according to claim 9;

adjusting the position of the elongated boom (19) on the elevated horizontal beam (20) so that in combination with the position of the platform (11) next to the drilling rig (3) the drill rod (2) and winch cable (7) guiding means (21) at maximum travel towards the drill mast (5) along the elongated boom (19) enables the assembly or disassembly of the drill string with the winch (6) and haul plug (8);

with the drill rod (2) and winch cable (7) guiding means (21) positioned at said point of maximum travel towards the mast (5) and the main winch cable (7) with haul plug (8) and required adaptor (9) passed through a grooved traveling roller (22) thereof;

positioning the haul plug (8) with adaptor (9) for screwing into the box end of the drill rod (2) which is at the top of the drill string;

screwing the haul plug (8) to the drill rod (2);

actuating the main winch (6) to lift the drill rod (2), remove the rod (2) from the drill string and further lift the drill rod (2) so it makes contact with the grooved traveling roller (22) of the drill rod (2) and winch cable (7) guiding means (21);

lowering and carrying the drill rod (2) from the mast (5) to the platform (11) with the main winch (6) holding the box end of the rod (2) and the winch cable (7) and drill rod (2) guiding means (21) moving along the elongated boom (19) in the direction of the platform (11), the winch cable (7) and drill rod (2) guiding means (21) pulling the rod (2) towards the platform (11) in the process while maintaining contact with the drill rod (2) at all times until it reaches a point vertically above the proximal end (13) of the platform (11), the threaded pin end of the drill rod (2) dropping and sliding by gravity towards the distal end (14) of the platform (11) until the drill rod (2) finally completely drops to the platform (11); and unscrewing the haul plug (8) with adaptor (9) from the drill rod (2) with the hand-held haul plug spinner (24).

19. The method of handling drill rods (2) according to claim 17, wherein after unscrewing the haul plug (8) with adaptor (9) from the drill rod (2), the winch cable (7) and haul plug (8) with adapter (9) is repositioning on the mast (5) for the next rod (2) at the top of the drill string by means of the winch cable (7) and drill rod (2) guiding means (21) moving back towards the mast (5) with the winch cable (7) and haul plug (8) passed over the grooved traveling roller (22).

* * * * *